US009691321B2

(12) United States Patent
Eom

(10) Patent No.: US 9,691,321 B2
(45) Date of Patent: Jun. 27, 2017

(54) ORGANIC LIGHT EMITTING DIODE DISPLAY DEVICE AND METHOD OF DRIVING THE SAME

(71) Applicant: LG Display Co., Ltd., Seoul (KR)

(72) Inventor: Eun-Cheol Eom, Gimje-si (KR)

(73) Assignee: LG Display Co., Ltd., Seoul (KR)

( * ) Notice: Subject to any disclaimer, the term of this patent is extended or adjusted under 35 U.S.C. 154(b) by 184 days.

(21) Appl. No.: 14/586,498

(22) Filed: Dec. 30, 2014

(65) Prior Publication Data

US 2015/0187262 A1 Jul. 2, 2015

(30) Foreign Application Priority Data

Dec. 31, 2013 (KR) ..... 10-2013-0168894

(51) Int. Cl.

| | |
|---|---|
| ***G09G 5/10*** | (2006.01) |
| ***G09G 3/30*** | (2006.01) |
| ***G09G 3/3208*** | (2016.01) |
| ***G09G 3/3275*** | (2016.01) |
| ***G09G 5/14*** | (2006.01) |

(52) U.S. Cl.

CPC ..... *G09G 3/3208* (2013.01); *G09G 3/3275* (2013.01); *G09G 5/14* (2013.01); *G09G 2310/027* (2013.01); *G09G 2310/08* (2013.01); *G09G 2320/0247* (2013.01); *G09G 2320/0261* (2013.01); *G09G 2320/0673* (2013.01); *G09G 2320/0686* (2013.01); *G09G 2330/022* (2013.01); *G09G 2330/028* (2013.01); *G09G 2360/16* (2013.01)

(58) Field of Classification Search

CPC ..... G09G 3/3208; G09G 3/3275; G09G 2320/0247; G09G 2320/0261; G09G 2320/0673; G09G 2320/0686; G09G 2310/08; G09G 2310/027; G09G 2330/028; G09G 2330/022; G09G 2360/16

USPC ..... 345/690, 76–83

See application file for complete search history.

(56) References Cited

U.S. PATENT DOCUMENTS

| | | | | |
|---|---|---|---|---|
| 2004/0150653 | A1 | 8/2004 | Sakamaki et al. | |
| 2005/0052446 | A1 | 3/2005 | Plut | |
| 2005/0264222 | A1 | 12/2005 | Lee et al. | |
| 2010/0066698 | A1* | 3/2010 | Seo | G06F 3/04883 345/173 |

(Continued)

FOREIGN PATENT DOCUMENTS

| | | | |
|---|---|---|---|
| CN | 1702713 | A | 11/2005 |
| CN | 102024423 | A | 4/2011 |

*Primary Examiner* — Jimmy H Nguyen

(74) *Attorney, Agent, or Firm* — Birch, Stewart, Kolasch & Birch, LLP

(57) ABSTRACT

An organic light emitting diode (OLED) display device using split window technology and a method of controlling the OLED display device. The OLED display device includes a system configured to split a display panel into a plurality of regions and operate in separate modes including a split window mode for transmitting split image data corresponding to respective regions to display different images on the respective regions and a normal mode for transmitting normal image data to display one image on the entire display panel, and a panel driving circuit configured to drive the display panel according to the split image data or the normal image data provided from the system.

20 Claims, 9 Drawing Sheets

(56) References Cited

U.S. PATENT DOCUMENTS

| | | | | |
|---|---|---|---|---|
| 2011/0069098 | A1* | 3/2011 | Lee ..... | G09G 3/3225<br>345/691 |
| 2013/0076803 | A1 | 3/2013 | Lee et al. | |
| 2013/0257913 | A1 | 10/2013 | Park et al. | |

* cited by examiner (SPLIT WINDOW MODE)

ORGANIC LIGHT EMITTING DIODE DISPLAY DEVICE AND METHOD OF DRIVING THE SAME

This application claims the benefit of Korean Patent Application No. 10-2013-0168894, filed on Dec. 31, 2013, which is hereby incorporated by reference as if fully set forth herein.

BACKGROUND OF THE INVENTION

Field of the Invention

The present invention relates to an organic light emitting diode (OLED) display device using split window technology and a method of driving the same.

Discussion of the Related Art

Mobile information devices in related art include organic light emitting diode (OLED) display devices that use OLEDs. Display panels of the mobile information devices in related art include OLED display devices having an increased size. The mobile information devices include split window technology for splitting a screen of an OLED display device into a plurality of regions and displaying different images in respective regions formed by splitting the screen. However, the OLED display devices in related art using split window technology apply the same image quality enhancing algorithm and the same power consumption reduction algorithm to the respective regions and thus there is a need to optimize an algorithm for enhancement of image quality and reduction of power consumption.

SUMMARY OF THE INVENTION

Accordingly, the present invention is directed to an organic light emitting diode (OLED) display device and a method of driving the same that substantially obviate one or more problems due to limitations and disadvantages of the related art. An object of the present invention is to provide an OLED display device and a method of driving the same, for enhancing image quality and reducing power consumption for split window technology.

Additional advantages, objects, and features of the invention will be set forth in part in the description which follows and in part will become apparent to those having ordinary skill in the art upon examination of the following or can be learned from practice of the invention. The objectives and other advantages of the invention can be realized and attained by the structure particularly pointed out in the written description and claims hereof as well as the appended drawings.

To achieve these objects and other advantages and in accordance with the purpose of the invention, as embodied and broadly described herein, an organic light emitting diode (OLED) display device includes a system configured to split a display panel into a plurality of regions and operate in separate modes including a split window mode for transmitting split image data corresponding to respective regions to display different images on the respective regions and a normal mode for transmitting normal image data to display one image on the entire display panel, and a panel driving circuit configured to drive the display panel according to the split image data or the normal image data provided from the system, separately control luminance or color characteristics of each of the plurality of regions according to a result obtained by analyzing the split image data in the split window mode, and control a specific region in a lowest luminance state until a user input signal is generated when the user input signal is not present during a predetermined period of time or more in the specific portion of the plurality of regions.

The panel driving circuit can include a gate driver configured to sequentially supply scan pulses to gate lines of the display panel and sequentially scan the plurality of regions, a data driver configured to apply a data voltage to data lines of the display panel, a timing controller configured to align the split image data or the normal image data provided from the system and supply the split image data or the normal image data to the data driver, generate a gate control signal for control of the gate driver and a data control signal for control of the data driver using an external input synchronization signal, and output a luminance control signal according to a result obtained by analyzing the split image data or the normal image data, and a gamma voltage generating circuit configured to a reference gamma voltage and supply the reference gamma voltage to the data driver, and vary the reference gamma voltage in response to the luminance control signal. In the split window mode, the timing controller varies the luminance control signal according to a result obtained by analyzing each split image data and varies the luminance control signal in synchronization with a period in which the gate driver scans each of the plurality of regions.

In the split window mode, the data driver can set image data corresponding to a last horizontal line of an $N^{th}$ region as blank data, set a specific horizontal period after scanning of the $N^{th}$ region is terminated, as a blank period, convert the blank data into the data voltage and output the data voltage during the blank period and simultaneously store split image data of an $(N+1)^{th}$ region, provided from the timing controller, in a line memory in an order in which the split data is input, and convert and output the split image data of the $(N+1)^{th}$ region into the data voltage in an order in which the split image data is stored in the line memory after the blank period is terminated.

In the split window mode, the timing controller can vary the luminance control signal to a value corresponding to the $(N+1)^{th}$ region during the blank period between a period for scanning of the $N^{th}$ region and a period for scanning of the $(N+1)^{th}$ region, and in the split window mode, the gamma voltage generating circuit can convert the reference gamma voltage to a value corresponding to the $(N+1)^{th}$ region in response to the luminance control signal corresponding to the $(N+1)^{th}$ region during the blank period.

In the split window mode, the timing controller can calculate an average picture level for each of the plurality of regions and generates the luminance control signal for each of the plurality of regions according to the average picture level, and the gamma voltage generating circuit can generate the luminance control signal for increasing the reference gamma voltage when an average picture level of each of the plurality of regions is relatively low, and generate the luminance control signal for reducing the reference gamma voltage when the average picture level of each of the plurality of regions is relatively high.

In the split window mode, the system can insert blank data into split data of neighboring regions and transmit the split data.

In another aspect of the present invention, a method of driving an organic light emitting diode (OLED) display device including a system configured to split a display panel into a plurality of regions and operate in separate modes including a split window mode for transmitting split image data corresponding to the respective regions in order to display different images on the respective regions and a normal mode for transmitting normal image data to display one image on the entire display panel, and a panel driving circuit configured to drive the display panel according to the split image data or the normal image data provided from the system, the method including separately controlling luminance or color characteristics of each of the plurality of regions according to a result obtained by analyzing the split image data by the panel driving circuit, and controlling a specific region in a lowest luminance state by the panel driving circuit until a user input signal is generated when the user input signal is not present during a predetermined period of time or more in the specific portion of the plurality of regions.

The panel driving circuit can include a gate driver configured to sequentially supply scan pulses to gate lines of the display panel and sequentially scan the plurality of regions, a data driver configured to apply a data voltage to data lines of the display panel, a timing controller configured to align the split image data or the normal image data provided from the system and supply the split image data or the normal image data to the data driver, generate a gate control signal for control of the gate driver and a data control signal for control of the data driver using an external input synchronization signal, and output a luminance control signal according to a result obtained by analyzing the split image data or the normal image data, and a gamma voltage generating circuit configured to generate a reference gamma voltage and supply the reference gamma voltage to the data driver, and vary the reference gamma voltage in response to the luminance control signal. In the split window mode, the timing controller varies the luminance control signal according to a result obtained by analyzing each split image data and varies the luminance control signal in synchronization with a period in which the gate driver scans each of the plurality of regions.

In the split window mode, the data driver can set image data corresponding to a last horizontal line of an $N^{th}$ region as blank data, set a specific horizontal period after scanning of the $N^{th}$ region is terminated, as a blank period, convert the blank data into the data voltage and outputs the data voltage during the blank period and simultaneously store split image data of an $(N+1)^{th}$ region, provided from the timing controller, in a line memory in an order in which the split data is input, and convert and output the split image data of the $(N+1)^{th}$ region into the data voltage in an order in which the split image data is stored in the line memory after the blank period is terminated.

In the split window mode, the timing controller can vary the luminance control signal to a value corresponding to the $(N+1)^{th}$ region during the blank period between a period for scanning of the $N^{th}$ region and a period for scanning of the $(N+1)^{th}$ region, and in the split window mode, the gamma voltage generating circuit can convert the reference gamma voltage to a value corresponding to the $(N+1)^{th}$ region in response to the luminance control signal corresponding to the $(N+1)^{th}$ region during the blank period.

In the split window mode, the timing controller can calculate an average picture level for each of the plurality of regions and generates the luminance control signal for each of the plurality of regions according to the average picture level, and the gamma voltage generating circuit can generate the luminance control signal for increasing the reference gamma voltage when an average picture level of each of the plurality of regions is relatively low, and generates the luminance control signal for reducing the reference gamma voltage when the average picture level of each of the plurality of regions is relatively high.

In the split window mode, the system can insert blank data into split data of neighboring regions and transmits the split data.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate an embodiment of the invention and together with the description serve to explain the principle of the invention. In the drawings.

DETAILED DESCRIPTION OF THE INVENTION

An organic light emitting diode (OLED) display device and a method of driving the same will be described in detail according to embodiments of the present invention with reference to the accompanying drawings.

Figure 1:
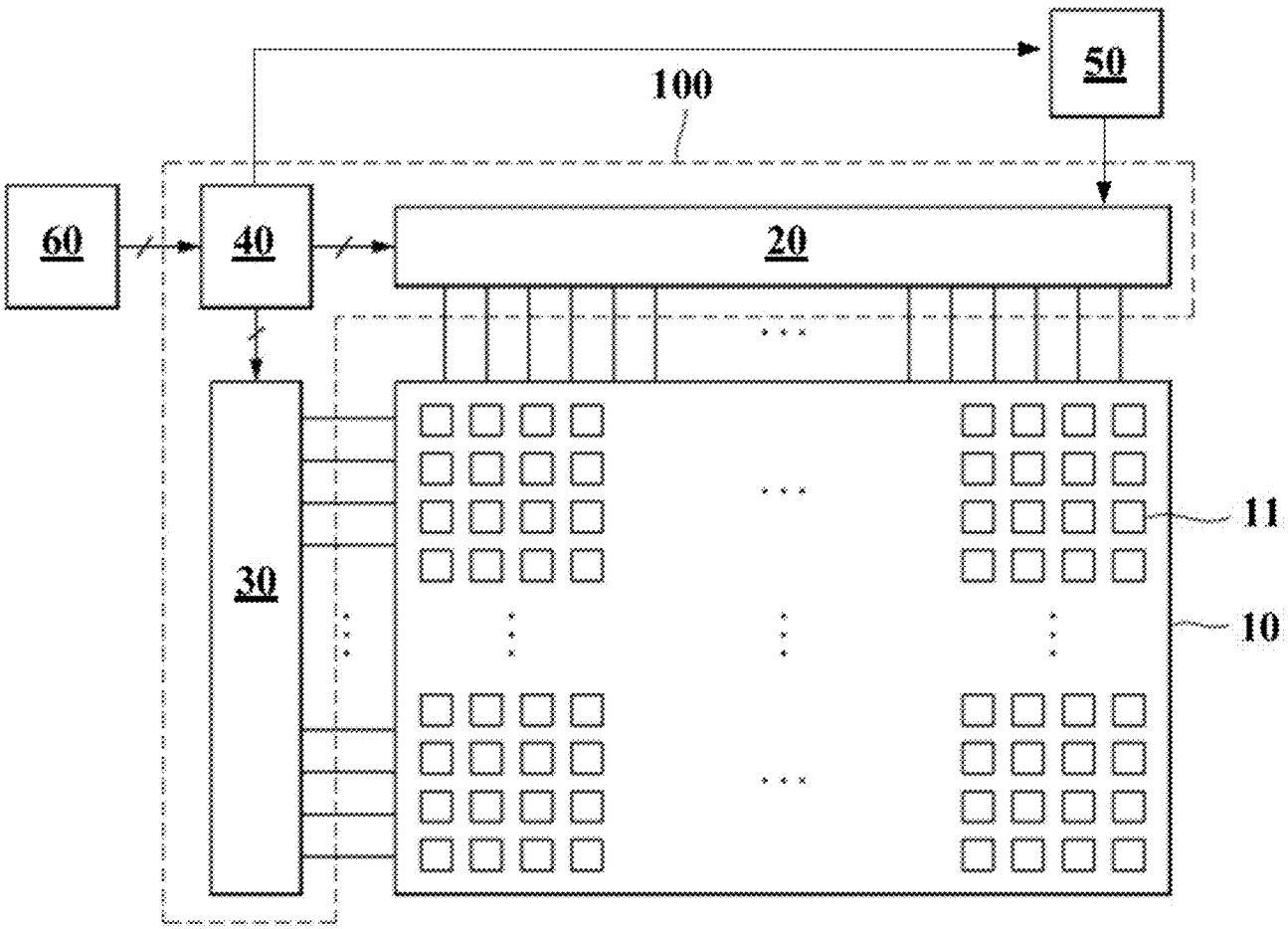
FIG. 1 is a diagram of an organic light emitting diode (OLED) display device according to an embodiment of the present invention.

FIG. 1 is a diagram of an OLED display device according to an embodiment of the present invention. The OLED display device includes a host system 60, a display panel 10, a data driver 20, a gate driver 30, a gamma voltage generating circuit 50, and a timing controller 40.

The display panel 10 includes data lines via which a data voltage is applied, gate lines that intersect the data lines and via which scan pulses SCANs and light emitting control pulses EMs are sequentially supplied, and light emitting cells 11 that are arranged in matrix form. A high potential power voltage VDDEL is applied to the light emitting cells 11. Each of the light emitting cells 11 includes a plurality of thin film transistors, a capacitor, and an OLED. The data driver 20, the gate driver 30, the gamma voltage generating circuit 50, and the timing controller 40 can be integrated in the form of one chip to constitute a panel driving circuit chip 100.

The data driver 20 (or a source driver) partitions reference gamma voltages provided from the gamma voltage generating circuit 50 to generate a plurality of gamma compensating voltages. The data driver 20 converts digital video data RGB into a gamma compensating voltage to generate a data voltage under control of the timing controller 40 and applies the data voltage to the data lines DL.

The gate driver 30 supplies the scan pulses SCANs and the light emitting control pulses Ems to the gate lines under control of the timing controller 40. The gate driver 30 can be embedded in a non-display region of the display panel 10. The gate driver 30 can be integrated with and connected to one side of the display panel 10.

The gamma voltage generating circuit 50 generates a plurality of reference gamma voltages and applies the reference gamma voltages to the data driver 20 under control of the timing controller 40. The gamma voltage generating circuit 50 can include a programmable gamma integrated circuit (IC) that changes a gamma voltage or curve in response to a luminance control signal PLCC provided from the timing controller 40.

The timing controller 40 generates timing control signals for controlling operation timing of the gate driver 30 and the data driver 20 based on a timing signal input from the host system 60. The timing signal can include a vertical/horizontal synchronization signal or a clock signal. The timing controller 40 supplies input image data from the host system 60 to the data driver 20.

The host system 60 can be a phone system in a mobile information device. The host system 60 is connected to a communication module, a camera module, an audio processing module, an interface module, a battery, a user input device, and the panel driving circuit chip 100.

Figure 2:
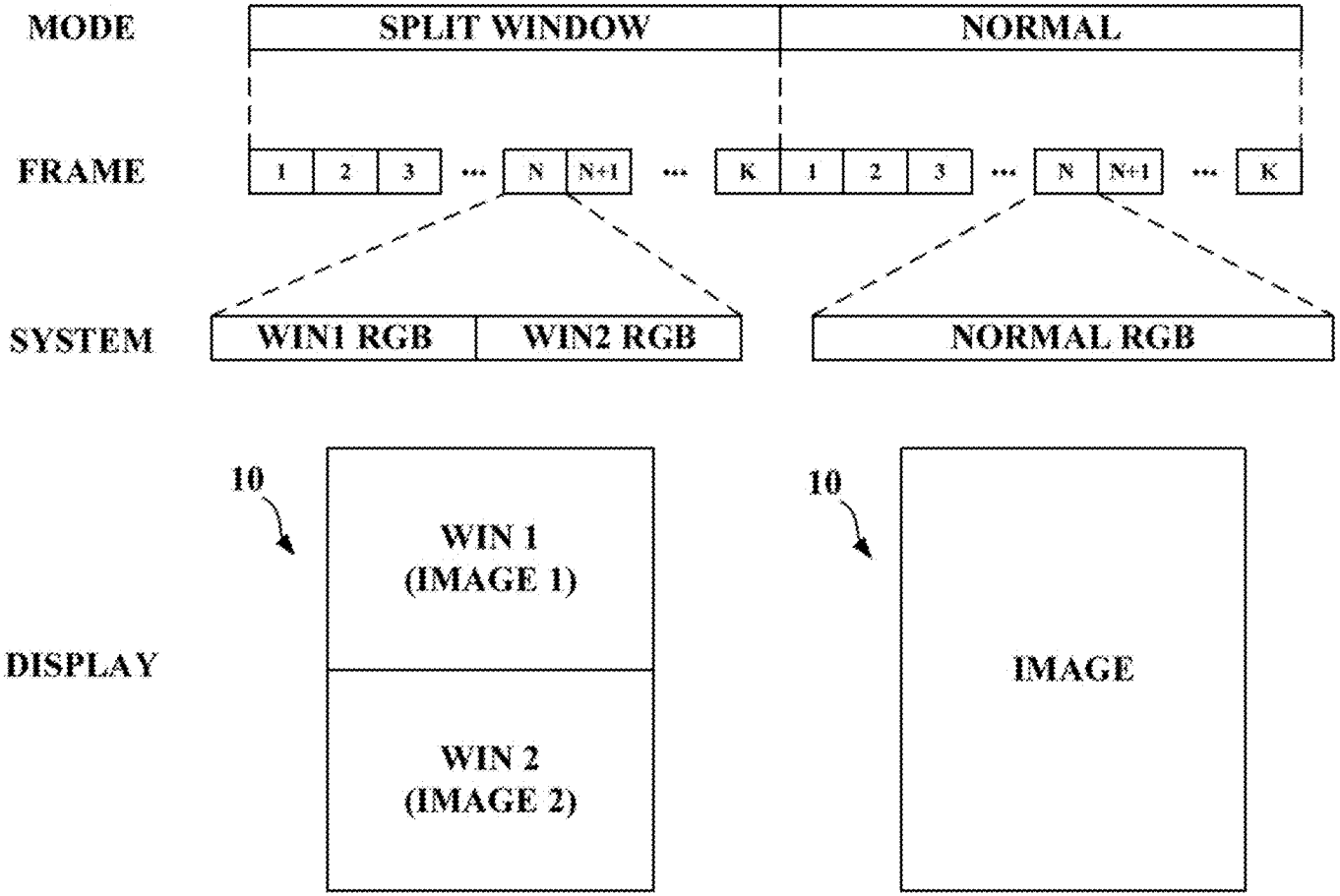
FIG. 2 is a diagram for explanation of a mode conversion of a host system.

Next, FIG. 2 illustrates the host system 60 that splits the display panel 10 into a plurality of regions and operates in separate modes including a split window mode for transmitting split image data corresponding to the respective regions to display different images on the respective regions and a normal mode for transmitting normal image data to display one image on the entire display panel.

Hereinafter, for convenience of description, a plurality of regions includes a first window region WIN1 and a second window region WIN2.

The host system 60 splits the display panel 10 into the first and second window regions WIN1 and WIN2 and sequentially transmits first split image data WIN1 RGB and second split image data WIN2 RGB, which correspond to the respective window regions, every frame. Accordingly, the first and second window regions WIN1 and WIN2 display different images IMAGE1 and IMAGE2, respectively. The first window region WIN1 can be disposed above the second window region WIN2.

Figure 3:
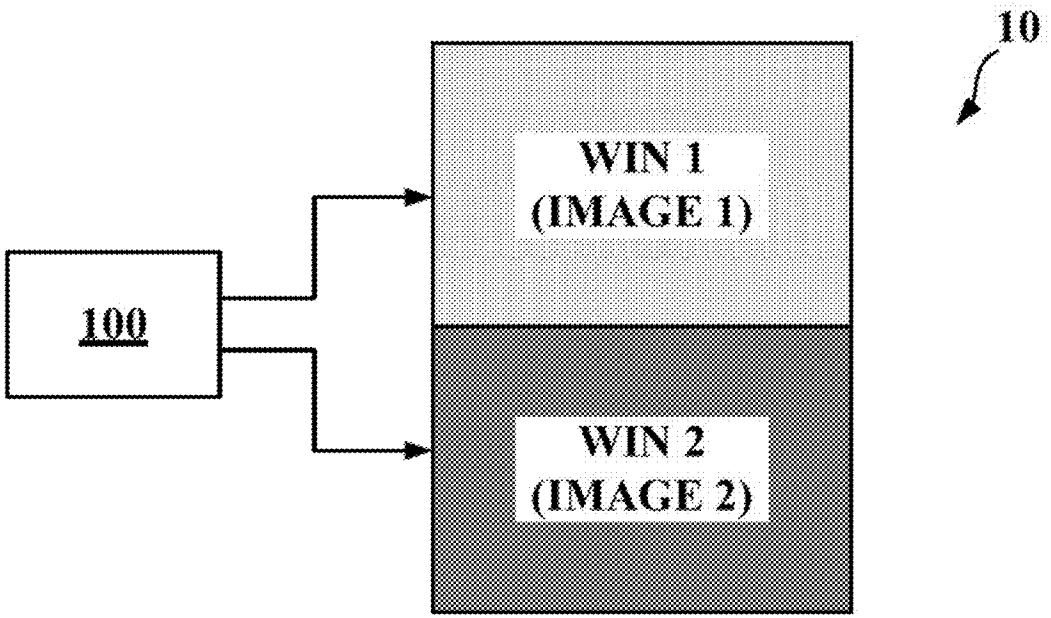
FIG. 3 is a diagram for explanation of an operation in a split window mode of a panel driving circuit chip.

In the normal mode, the host system 60 transmits normal image data every frame. In the split window mode, the host system 60 pre-transmits the first split image data WIN1 RGB every frame and then transmits the second split image data WIN2 RGB. The panel driving circuit chip 100, in the split window mode, analyzes the first and second split image data WIN1 RGB and WIN2 RGB corresponding to the first and second window regions WIN1 and WIN2 (refer to FIG. 3). In addition, the panel driving circuit chip 100 separately controls luminance or color characteristics of the first and second window regions WIN1 and WIN2 according to the analysis results of the first and second split image data WIN1 RGB and WIN2 RGB. Hereinafter, a method of separately controlling luminance of the first and second window regions will be described in detail. In addition, according to the present invention, a method of separately controlling luminance of the first and second window regions includes separately controlling the color characteristics of the first and second window regions. Various conventionally known image quality control algorithms can be applied to control the color characteristics.

When the first split image data WIN1 RGB has relatively high luminance, the panel driving circuit chip 100 can reduce the luminance of the first window region WIN1, and when the second split image data WIN2 RGB has relatively low luminance, the panel driving circuit chip 100 can increase the luminance of the second window region WIN2. The panel driving circuit chip 100 varies a reference gamma voltage to separately control the luminance of the first and second window regions WIN1 and WIN2.

When a user input signal is not present during a predetermined period of time or more in a specific portion of the first and second window regions WIN1 and WIN2, the panel driving circuit chip 100 controls the specific region in a lowest luminance state until the user input signal is generated.

For example, when a user input signal with respect to the second window region WIN2 of the first and second window regions WIN1 and WIN2 is not present during a predetermined period of time, the panel driving circuit chip 100 changes the second window region WIN2 into a lowest luminance state to drive the second window region WIN2 in a low power mode. When a user input signal is supplied to the second window region WIN2 in a low power mode, the panel driving circuit chip 100 controls the second window region WIN2 to have normal luminance.

Figure 4:
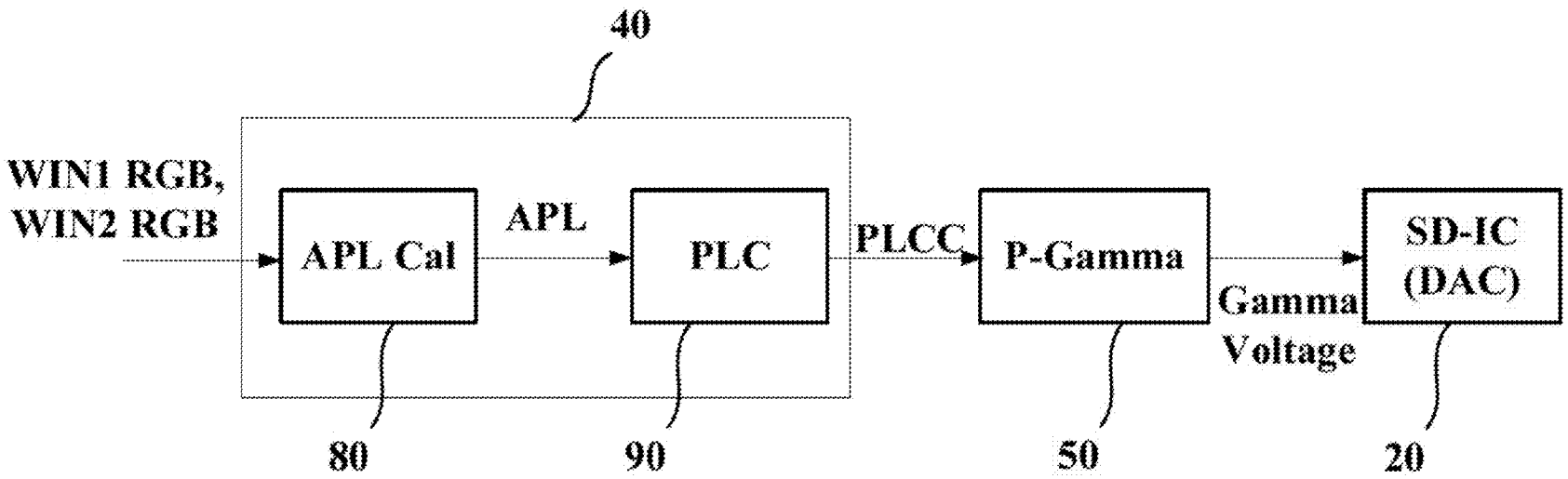
FIG. 4 is a diagram illustrating a partial structure of a timing controller illustrated in FIG. 1 and illustrates components of a timing controller for controlling luminance of a display panel.

Next, FIG. 4 illustrates the timing controller 40 that includes an average picture level calculator 80 and a peak luminance controller 90. The average picture level calculator 80 analyzes the first and second split image data WIN1 RGB and WIN2 RGB or normal image data RGB input from the host system 60 to calculate an average picture level (APL). The average picture level calculator 80 can employ a conventionally known method to calculate the APL. For example, the average picture level calculator 80 can detect luminance components of image data and calculate an APL according to the detected luminance components. In addition, the average picture level calculator 80 can detect luminance components of image data and calculate an APL according to a mode among the detected luminance components.

The peak luminance controller 90 controls maximum luminance of each of the first and second window regions WIN1 and WIN2 according to the calculated APL from the average picture level calculator 80. The peak luminance controller 90 refers to a lookup table in which a plurality of PLCCs is mapped to a plurality of APLs, respectively. The peak luminance controller 90 generates a PLCC according to an APL of each of the first and second window regions WIN1, WIN2 with reference to the lookup table. The peak luminance controller 90 generates a PLCC for increasing maximum luminance as an APL of a corresponding region increases. The peak luminance controller 90 generates a PLCC for increasing maximum luminance as an APL of a corresponding region decreases.

The peak luminance controller 90 varies the PLCC in synchronization with a period when the gate driver 30 scans the first and second window regions WIN1 and WIN2. Then a plurality of reference gamma voltages generated from the gamma voltage generating circuit 50 can be differently set during respective periods when the gate driver 30 scans the first and second window regions WIN1 and WIN2.

The gamma voltage generating circuit 50 generates a plurality of reference gamma voltages and applies the voltages to a digital analog converter of the data driver 20. The gamma voltage generating circuit 50 varies a plurality of reference gamma voltage levels according to the PLCC. When the gamma voltage generating circuit 50 increases the plural reference gamma voltage levels, maximum luminance is increased and luminance of a corresponding region is increased. When the gamma voltage generating circuit 50 reduces the plural reference gamma voltage levels, the maximum luminance is reduced and luminance of a corresponding region is reduced.

Figure 5:
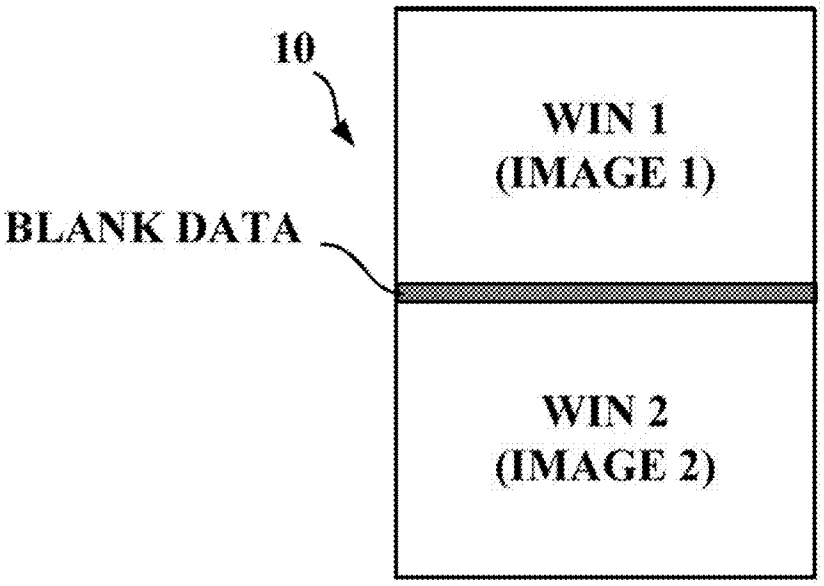
FIG. 5 is a plan view of a display panel for explanation of blank data.

Next, FIG. 5, illustrates, for a split mode, blank data that is inserted between the first and second window regions WIN1 and WIN2. To this end, the data driver 20 outputs blank data in synchronization with a period in which the gamma voltage generating circuit 50 varies a plurality of gamma voltage levels. The blank data can be black data. The blank data can be generated by a line memory 28 of the data driver 20.

In the split window mode, the timing controller 40 sets a period between a period in which the gate driver 30 scans the first window region WIN1 and a period in which the gate driver 30 scans the second window region WIN2 as a blank period. In addition, the timing controller 40 varies a PLCC to a value for setting luminance of a second window region during the blank period.

Figure 6:
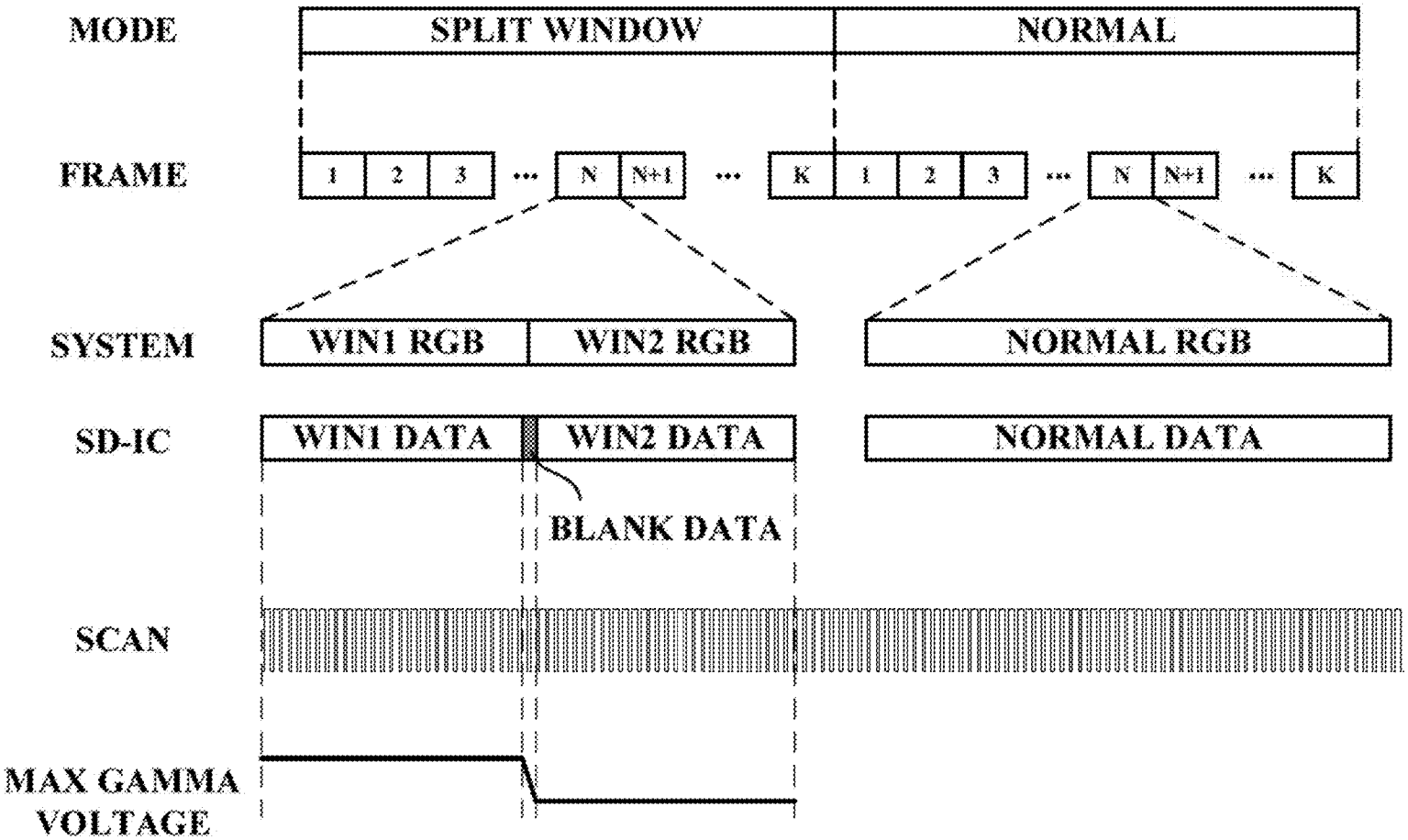
FIG. 6 is a diagram for explanation of a point in time when a reference gamma voltage level is varied.

Next, FIG. 6 illustrates maximum reference gamma voltage generated from the gamma voltage generating circuit 50. The maximum reference gamma voltage is maintained at a first level during the period when the gate driver 30 scans the first window region WIN1. The first level is a value that is set under control of the timing controller 40 (more particularly, a peak luminance controller) according to a luminance analysis of the first split image data WIN1 RGB.

Then, after scanning of the first window region WIN1 is terminated, the maximum reference gamma voltage is varied to a second level from the first level during a specific horizontal period. The specific horizontal period is defined as a blank period and the data driver 20 outputs blank data during the blank period. Then, after the blank period is terminated, the gate driver 30 scans the second window region WIN2. The maximum gamma voltage is maintained at the second level during a period when the gate driver 30 scans the second window region WIN2. The second level is a value that is set under control of the timing controller 40 according to a luminance analysis result of the second split image data WIN2 RGB. That is, the second level is a value, that is set based on a PLCC that is output to set luminance of the second window region by the timing controller 40.

Likewise, according to the present invention, the gamma voltage generating circuit 50 varies a plurality of gamma voltage levels during a blank period between the period for scanning of the first window region WIN1 and the period for scanning of the second window region WIN2 and separately controls luminance of each region. In addition, the data driver 20 generates and outputs blank data during the blank period. Accordingly, luminance of each region can be separately controlled to reduce power consumption and blank data can be output during the blank period to prevent reduction in image quality, which can occur when gamma voltage is varied.

Figure 7:
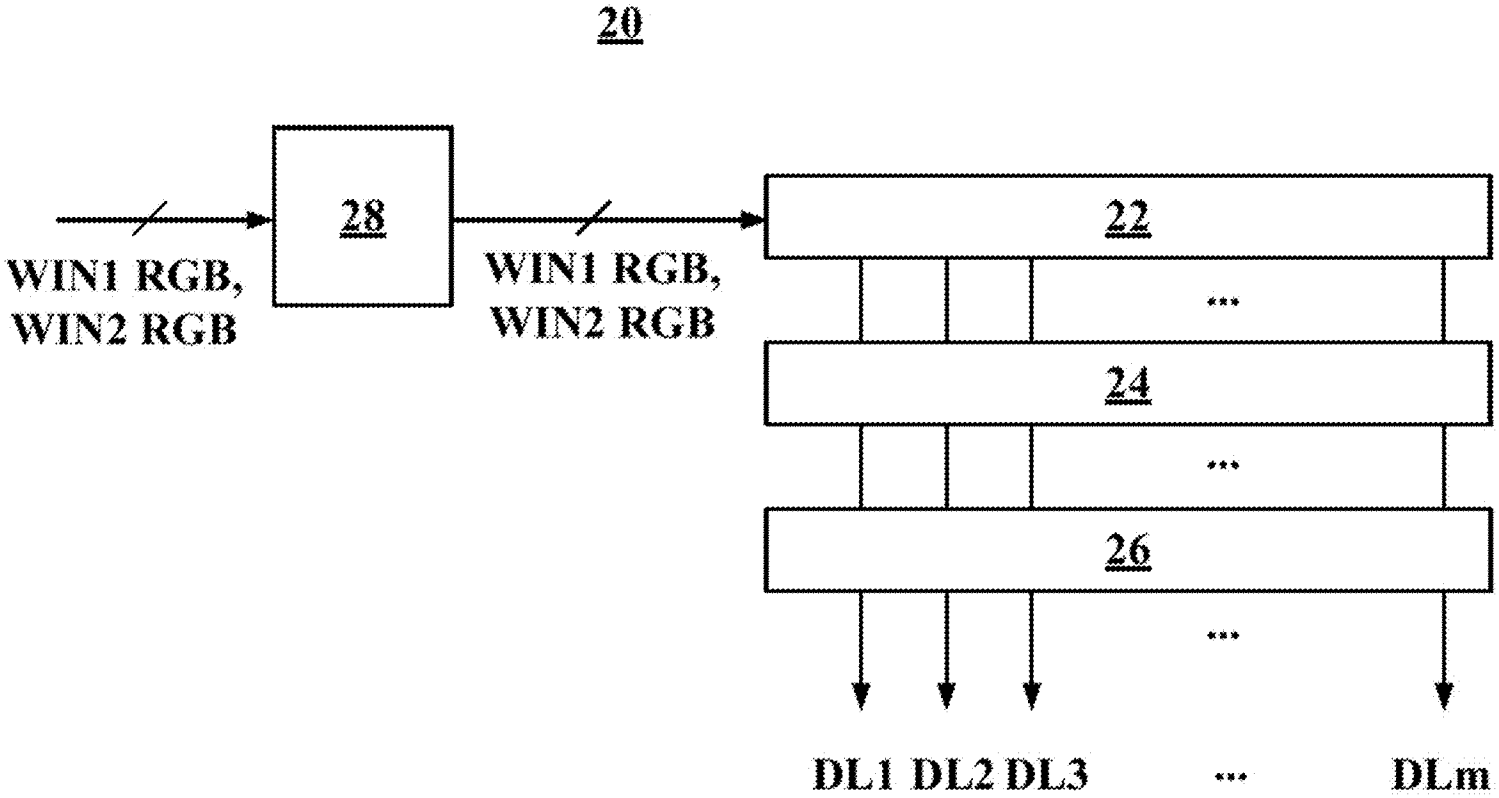
FIG. 7 is a diagram illustrating a structure of a data driver illustrated in FIG. 1.

Next, FIG. 7 illustrates the data driver 20 that sets image data corresponding to a last horizontal line of an $N^{th}$ region to blank data and sets a specific horizontal period after scanning of the $N^{th}$ region is terminated, as a blank period. The data driver 20 converts the blank data into the data voltage and outputs the data voltage during the blank period and simultaneously stores split image data of an $(N+1)^{th}$ region, provided from the timing controller, in the line memory in the order in which the split data is input. The data driver 20 converts and outputs the split image data of the $(N+1)^{th}$ region into the data voltage in the order in which the split image data is stored in the line memory after the blank period is terminated.

The data driver 20 includes the line memory 28, a latch 22, a digital analog converter 24, and a buffer 26. The line memory 28 is enabled in a split window mode. The line memory 28 bypasses split image data that is first input among a plurality of pieces of split image data to the latch 22. That is, the line memory 28 bypasses the first split image data WIN1 RGB to the latch 22.

Figure 8:
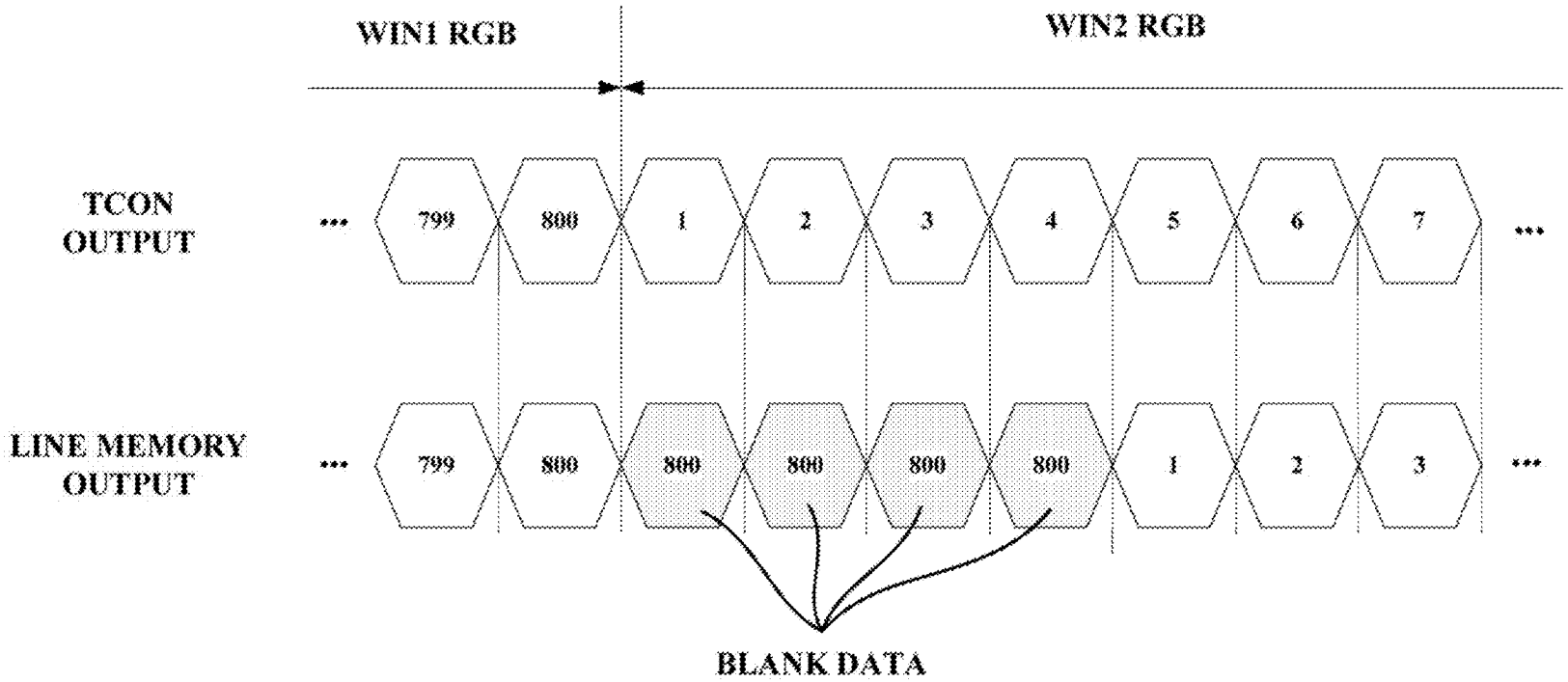
FIG. 8 is a diagram illustrating imager data output from a line memory.

Next, FIG. 8 illustrates the line memory 28 that sets image data 800 corresponding to a last horizontal line of the first split image data WIN1 RGB to blank data. In addition, the line memory 28 supplies the blank data to the latch 22 during the blank period and simultaneously stores the second split image data WIN2 RGB input from the timing controller 40 in the order in which a plurality of pieces of the second split image data WIN2 RGB is input. Although the blank period can be horizontal period 4 (refer to FIG. 8), the blank period can be any one selected from horizontal periods 1 to 10.

The line memory 28 supplies the second split image data WIN2 RGB to the latch 22 in the order in which a plurality of the second split image data WIN2 RGB is stored after the blank period is terminated. Accordingly, the second split image data RGB supplied to the data driver 20 from the timing controller 40 is delayed in the line memory 28 by as much as a specific horizontal period and is supplied to the latch 22. The latch 22 latches image data input through the line memory 28 in each horizontal line and outputs the image data.

The digital analog converter 24 partitions a plurality of reference gamma voltages supplied from the gamma voltage generating circuit 50 to generate a plurality of gamma compensating voltages. The digital analog converter 24 converts image data input from the latch 22 into a data voltage using a plurality of gamma compensating voltages and outputs the data voltage. The buffer 26 is connected to each of a plurality of data lines DL1 to DLm in a one to one correspondence to stabilize output of the data voltage.

Figure 9:
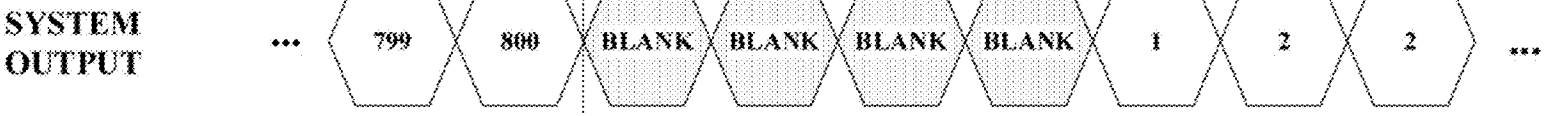
FIG. 9 is a diagram illustrating output image data of a host system in a split window mode.

Next, FIG. 9 illustrates that, in addition to blank data being generated by a data driver (refer to FIG. 8), the blank data can be originally transmitted from the host system 60. The host system 60 inserts blank data into each blank period and transmits image data in a split window mode. In this case, the line memory 28 may not be included in the data driver 20.

The gamma voltage generating circuit 50 varies a plurality of gamma voltage levels to separately control luminance of each region during a blank period between a period for scanning the first window region WIN1 and a period for scanning the second window region WIN2. In addition, in the blank period, the data driver 20 generates and outputs the blank data. Accordingly, luminance of each region can be separately controlled so as to reduce unnecessary power consumption, and blank data can be output during a blank period to prevent reduction in image quality which can occur when gamma voltages are varied.

According to the present invention, a gamma voltage generating circuit varies a plurality of gamma voltage levels to separately control luminance of each region during a blank period between a period for scanning a first window region and a period for scanning a second window region. In addition, in the blank period, a data driver generates and outputs the blank data. Accordingly, luminance of each region can be separately controlled to reduce unnecessary power consumption, and blank data can be output during a blank period to prevent reduction in image quality which can occur when gamma voltages are varied.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting diode (OLED) display device comprising:

a system configured to:

split a display panel into a plurality of regions and operate in separate modes including a split window mode for transmitting split image data corresponding to respective regions to display different images on the respective regions and a normal mode for transmitting normal image data to display one image on the entire display panel; and a panel driving circuit configured to:

drive the display panel according to the split image data or the normal image data provided from the system, vary a plurality of gamma voltage levels to separately control luminance or color characteristics of each of the plurality of regions during a blank period between a period for scanning a first window region and a period for scanning a second window region according to a result obtained by analyzing the split image data in the split window mode, and control a specific region in a lowest luminance state until a user input signal is generated when the user input signal is not present during a predetermined period of time or more in the specific portion of the plurality of regions, wherein the panel driving circuit includes a gamma voltage generating circuit to vary the plurality of gamma voltage levels to reduce power consumption.

2. The OLED display device according to claim 1, wherein the panel driving circuit includes:

a gate driver configured to sequentially supply scan pulses to gate lines of the display panel and sequentially scan the plurality of regions;

a data driver configured to apply a data voltage to data lines of the display panel;

a timing controller configured to:

align the split image data or the normal image data provided from the system and supply the split image data or the normal image data to the data driver, generate a gate control signal for control of the gate driver and a data control signal for control of the data driver using an external input synchronization signal, and output a luminance control signal according to a result obtained by analyzing the split image data or the normal image data; and the gamma voltage generating circuit configured to generate a reference gamma voltage having a level, vary the level of the reference gamma voltage in response to the luminance control signal, and supply the level-varied reference gamma voltage to the data driver, wherein, in the split window mode, the timing controller varies the luminance control signal according to a result obtained by analyzing each split image data and varies the luminance control signal in synchronization with a period in which the gate driver scans each of the plurality of regions.

3. The OLED display device according to claim 2, wherein, in the split window mode, the data driver sets image data corresponding to a last horizontal line of an Nth region as blank data, sets a specific horizontal period after scanning of the Nth region is terminated, as a blank period, converts the blank data into the data voltage and outputs the data voltage during the blank period and simultaneously stores split image data of an (N+1)th region, provided from the timing controller, in a line memory in an order in which the split image data is input, and converts and outputs the split image data of the (N+1)th region into the data voltage in an order in which the split image data is stored in the line memory after the blank period is terminated, wherein N is a positive integer.

4. The OLED display device according to claim 3, wherein:

in the split window mode, the timing controller varies the luminance control signal to a value corresponding to the (N+1)th region during the blank period between a period for scanning of the Nth region and a period for scanning of the (N+1)th region, and in the split window mode, the gamma voltage generating circuit converts the reference gamma voltage to a value corresponding to the (N+1)th region in response to the luminance control signal corresponding to the (N+1)th region during the blank period.

5. The OLED display device according to claim 2, wherein:

in the split window mode, the timing controller calculates an average picture level for each of the plurality of regions and generates the luminance control signal for each of the plurality of regions according to the average picture level, and the timing controller generates the luminance control signal for increasing the reference gamma voltage when an average picture level of each of the plurality of regions is relatively low, and generates the luminance control signal for reducing the reference gamma voltage when the average picture level of each of the plurality of regions is relatively high.

6. The OLED display device according to claim 1, wherein, in the split window mode, the system inserts blank data into a region between neighboring window regions and transmits the blank data.

7. A method of driving an organic light emitting diode (OLED) display device comprising a system configured to split a display panel into a plurality of regions and operate in separate modes comprising a split window mode for transmitting split image data corresponding to respective regions to display different images on the respective regions and a normal mode for transmitting normal image data to display one image on the entire display panel, and a panel driving circuit configured to drive the display panel according to the split image data or the normal image data provided from the system, the method comprising:

varying a plurality of gamma voltage levels to separately controlling luminance or color characteristics of each of the plurality of regions during a blank period between a period for scanning a first window region and a period for scanning a second window region, according to a result obtained by analyzing the split image data by the panel driving circuit; and controlling a specific region in a lowest luminance state by the panel driving circuit until a user input signal is generated when the user input signal is not present during a predetermined period of time or more in the specific portion of the plurality of regions, wherein the panel driving circuit includes a gamma voltage generating circuit to vary the plurality of gamma voltage levels to reduce power consumption.

8. The method according to claim 7, wherein the panel driving circuit comprises:

a gate driver configure to sequentially supply scan pulses to gate lines of the display panel and sequentially scan the plurality of regions;

a data driver configured to apply a data voltage to data lines of the display panel;

a timing controller configured to align the split image data or the normal image data provided from the system and supply the split image data or the normal image data to the data driver, generate a gate control signal for control of the gate driver and a data control signal for control of the data driver using an external input synchronization signal, and output a luminance control signal according to a result obtained by analyzing the split image data or the normal image data; and the gamma voltage generating circuit configured to generate a reference gamma voltage having a level, vary the level of the reference gamma voltage in response to the luminance control signal, and supply the level-varied reference gamma voltage to the data driver, wherein, in the split window mode, the timing controller varies the luminance control signal according to a result obtained by analyzing each split image data and varies the luminance control signal in synchronization with a period in which the gate driver scans each of the plurality of regions.

9. The method according to claim 8, wherein, in the split window mode, the data driver sets image data corresponding to a last horizontal line of an Nth region as blank data, sets a specific horizontal period after scanning of the Nth region is terminated, as a blank period, converts the blank data into the data voltage and outputs the data voltage during the blank period and simultaneously stores split image data of an (N+1)th region, provided from the timing controller, in a line memory in an order in which the split image data is input, and converts and outputs the split image data of the (N+1)th region into the data voltage in an order in which the split image data is stored in the line memory after the blank period is terminated, wherein N is a positive integer.

10. The method according to claim 9, wherein:

in the split window mode, the timing controller varies the luminance control signal to a value corresponding to the (N+1)th region during the blank period between a period for scanning of the Nth region and a period for scanning of the (N+1)th region; and in the split window mode, the gamma voltage generating circuit converts the reference gamma voltage to a value corresponding to the (N+1)th region in response to the luminance control signal corresponding to the (N+1) th region during the blank period.

11. The method according to claim 8, wherein:

in the split window mode, the timing controller calculates an average picture level for each of the plurality of regions and generates the luminance control signal for each of the plurality of regions according to the average picture level; and the timing controller generates the luminance control signal for increasing the reference gamma voltage when an average picture level of each of the plurality of regions is relatively low, and generates the luminance control signal for reducing the reference gamma voltage when the average picture level of each of the plurality of regions is relatively high.

12. The method according to claim 7, wherein, in the split window mode, the system inserts blank data into a region between neighboring window regions and transmits the blank data.

13. An organic light emitting diode (OLED) display device comprising:

a display panel including gate lines and data lines;

a gate driver and a data driver configured to sequentially supply scan pulses to the gate lines panel, and apply a data voltage to the data lines, respectively; and a panel driving circuit chip including a timing controller, the gate driver, the data driver, and a gamma voltage generating circuit, wherein the panel driving circuit is configured to:

sequentially receive, from a system, first split image data and then second split image data to split the display panel into a plurality of regions in a split window mode in which different images are respectively displayed on the plurality of regions, and receive normal image data from the system in a normal mode in which one image is displayed on the entire display panel, and wherein the gamma voltage generating circuit is configured to vary a plurality of gamma voltage levels to separately control luminance of each region during a blank period between a period for scanning a first window region and a period for scanning a second window region.

14. The OLED display device according to claim 13, wherein the first split image data has relatively high luminance and the second split image data has relatively low luminance.

15. The OLED display device according to claim 14, wherein the panel driving circuit chip is further configured to:

separately control the luminance of the plurality of regions according to a result obtained by analyzing the first and second split image data in the split window mode, and control a specific region in a lowest luminance state until a user input signal is generated when the user input signal is not present during a predetermined period of time or more in a specific portion of the plurality of regions.

16. The OLED display device according to claim 15, wherein, in the split window mode, the data driver sets image data corresponding to a last horizontal line of an Nth region as blank data, sets a specific horizontal period after scanning of the Nth region is terminated, as a blank period, converts the blank data into the data voltage and outputs the data voltage during the blank period and simultaneously stores split image data of an (N+1)th region, provided from the timing controller, in a line memory in an order in which the split image data is input, and converts and outputs the split image data of the (N+1)th region into the data voltage in an order in which the split image data is stored in the line memory after the blank period is terminated, wherein N is a positive integer.

17. The OLED display device according to claim 13, further comprising:

an average picture level calculator configured to analyze the first and second split image data or normal image data input from the host system to calculate an average picture level (APL); and a peak luminance controller configured to control maximum luminance of each of the plurality of regions according to the calculated APL from the average picture level calculator.

18. The OLED display device according to claim 17, further comprising:

the gamma voltage generating circuit configured to generate a maximum reference gamma voltage that is maintained at a first level during a period when the gate driver scans a first of the plurality of regions.

19. The OLED display device according to claim 18, wherein the data driver includes a line memory, a latch and a buffer, and the data driver is configured to:

set image data corresponding to a last horizontal line of the first split image data to blank data, and supply the blank data to the latch during a blank period and simultaneously store the second split image data input from the timing controller in the order in which a plurality of pieces of the second split image data is input.

20. The OLED display device according to claim 18, wherein, in the split window mode, the data driver sets image data corresponding to a last horizontal line of an Nth region as blank data, sets a specific horizontal period after scanning of the Nth region is terminated, as the blank period, converts the blank data into the data voltage and outputs the data voltage during the blank period and simultaneously stores split image data of an (N+1)th region, provided from the timing controller, in the line memory in an order in which the split image data is input, and converts and outputs the split image data of the (N+1)th region into the data voltage in an order in which the split image data is stored in the line memory after the blank period is terminated, wherein N is a positive integer.

* * * * *